US011091305B2

(12) United States Patent
Martinson

(10) Patent No.: US 11,091,305 B2
(45) Date of Patent: Aug. 17, 2021

(54) SYSTEMS AND METHODS FOR MOUNTABLE AND CONNECTABLE TWIST TIES

(71) Applicant: Nite Ize, Inc., Boulder, CO (US)

(72) Inventor: Daniel J. Martinson, Medina, MN (US)

(73) Assignee: NITE IZE, INC., Boulder, CO (US)

( * ) Notice: Subject to any disclaimer, the term of this patent is extended or adjusted under 35 U.S.C. 154(b) by 0 days.

(21) Appl. No.: 14/777,215

(22) PCT Filed: Mar. 14, 2014

(86) PCT No.: PCT/US2014/027506

§ 371 (c)(1),
(2) Date: Sep. 15, 2015

(87) PCT Pub. No.: WO2014/152590

PCT Pub. Date: Sep. 25, 2014

(65) Prior Publication Data

US 2016/0009470 A1 Jan. 14, 2016

Related U.S. Application Data

(60) Provisional application No. 61/800,219, filed on Mar. 15, 2013.

(51) Int. Cl.

| | |
|---|---|
| ***B65D 63/18*** | (2006.01) |
| ***B65D 63/04*** | (2006.01) |
| ***B65D 63/10*** | (2006.01) |
| ***B65D 63/12*** | (2006.01) |
| ***A47F 5/00*** | (2006.01) |

(Continued)

(52) U.S. Cl.

CPC ..... *B65D 63/18* (2013.01); *A47F 5/0846* (2013.01); *A47F 5/0853* (2013.01); *B65D 63/04* (2013.01); *B65D 63/10* (2013.01); *B65D 63/12* (2013.01); *A47F 5/00* (2013.01); *F21V 21/08* (2013.01); *F21V 33/00* (2013.01)

(58) Field of Classification Search

CPC ..... B65D 63/00; B65D 63/10; B65D 63/12; B65D 63/04; B65D 63/18; F21V 21/08; F21V 33/00; A47F 5/00; A47F 5/08

USPC ..... 24/300, 16 PB, 30.5 T, 68 R

See application file for complete search history.

(56) References Cited

U.S. PATENT DOCUMENTS 3,328,854 A 7/1967 Tombari
3,462,802 A * 8/1969 Merser ..... B65D 63/1081 24/16 PB (Continued)

FOREIGN PATENT DOCUMENTS

CN 102080871 A 6/2011
CN 201932495 U 8/2011

(Continued)

OTHER PUBLICATIONS

Supplementary European Search Report dated Sep. 30, 2016 issued in parallel European Patent App. No. 14768547.3 (7 pages).

(Continued)

*Primary Examiner* — Tan Le
(74) *Attorney, Agent, or Firm* — Haynes and Boone, LLP

(57) ABSTRACT

An apparatus includes a body, the body including an attachment mechanism for mounting the body; and a twist tie, the twist tie integrated with the body.

23 Claims, 12 Drawing Sheets

(51) Int. Cl.

| | |
|---|---|
| ***A47F 5/08*** | (2006.01) |
| *F21V 33/00* | (2006.01) |
| *F21V 21/08* | (2006.01) |

(56) References Cited

U.S. PATENT DOCUMENTS

| | | | | |
|---|---|---|---|---|
| 3,543,353 | A | 12/1970 | Meehan | |
| 3,712,655 | A * | 1/1973 | Fuehrer | F16B 21/071 292/321 |
| 3,761,999 | A * | 10/1973 | Morgan | B65D 63/1072 24/16 PB |
| 4,156,443 | A | 5/1979 | Nishikawa et al. | |
| 4,592,355 | A * | 6/1986 | Antebi | A61B 17/122 606/144 |
| 4,708,311 | A | 11/1987 | Clausen et al. | |
| 4,805,784 | A | 2/1989 | Solheim et al. | |
| 6,848,663 | B2 | 2/2005 | Olive | |
| 7,730,592 | B2 * | 6/2010 | Krisel | B65D 63/1072 24/16 PB |
| 8,387,216 | B1 | 3/2013 | Martinson | |
| 8,806,723 | B2 * | 8/2014 | Martinson | B65D 63/00 24/16 PB |
| 8,876,694 | B2 * | 11/2014 | Honaryar | A61F 5/0056 600/37 |
| 2002/0118535 | A1 | 8/2002 | Nostrant | |
| 2006/0075610 | A1 * | 4/2006 | Buchanan | B65D 63/1018 24/300 |
| 2008/0201915 | A1 | 8/2008 | Obiols | |
| 2011/0286217 | A1 | 11/2011 | Martinson et al. | |
| 2012/0321890 | A1 | 12/2012 | Daniel | |
| 2013/0026316 | A1 * | 1/2013 | Case | B62J 11/00 248/205.1 |
| 2015/0152669 | A1 * | 6/2015 | Kindstrand | E05B 73/0005 70/15 |
| 2016/0009470 | A1 * | 1/2016 | Martinson | B65D 63/10 24/27 |

FOREIGN PATENT DOCUMENTS

| | | | |
|---|---|---|---|
| CN | 201942119 | U | 8/2011 |
| CN | 2023211454 | U | 7/2012 |
| DE | 2738005 | A1 | 3/1978 |
| WO | 2010001345 | A2 | 1/2010 |

OTHER PUBLICATIONS

International Search Report in related PCT Application No. PCT/US14/27506 dated Aug. 8, 2014 (4 pages).

First Office Action dated Dec. 2, 2016 in co-pending Chinese application No. 2014800269976 (25 pages with English translation).

Second Office Action dated Aug. 10, 2017 in co-pending Chinese application No. 2011800269976 (41 pages with Englishs translation).

Wu, Guangming, et al. "Plastic Mould Design," China Machine Press, the first edition, p. 41, Oct. 30, 2011 (English excerpt from Second Office Action dated Aug. 10, 2017 in lieu of translation) (17 pages).

* cited by examiner

FIG. 10
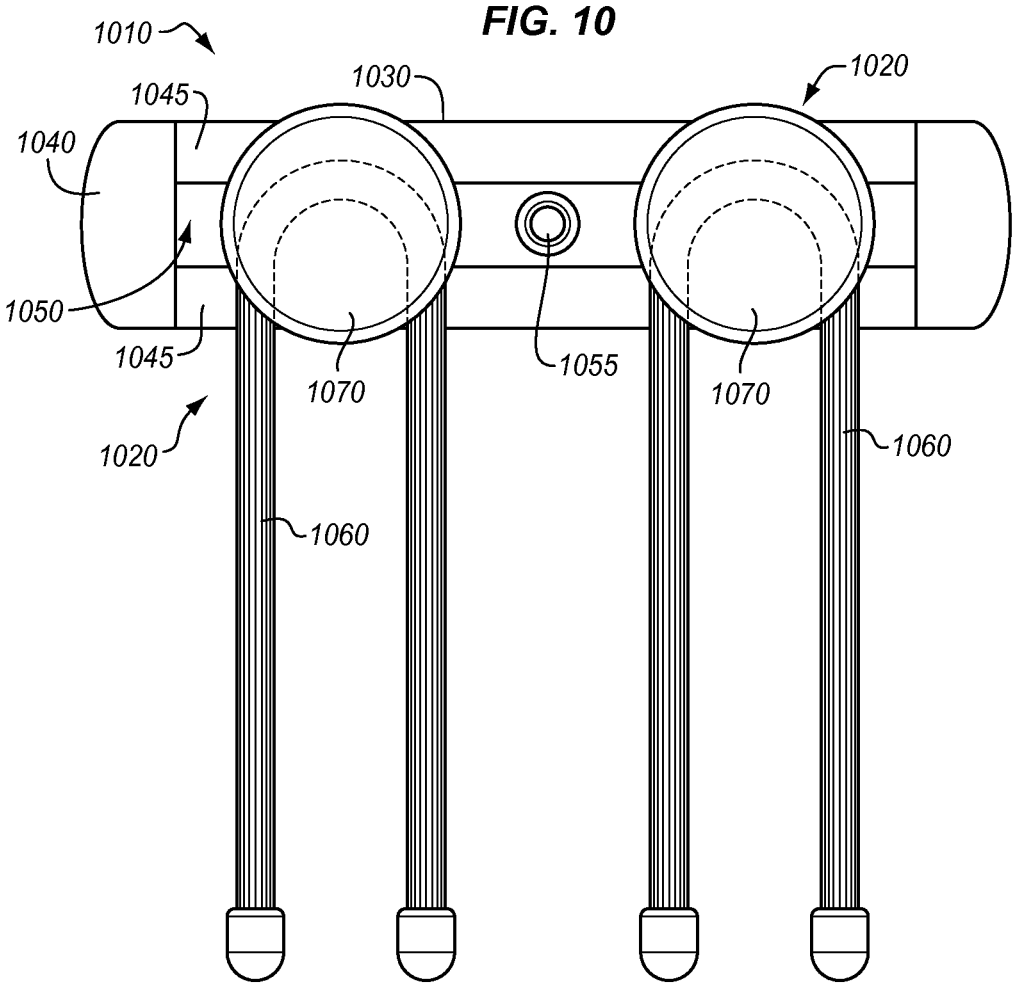
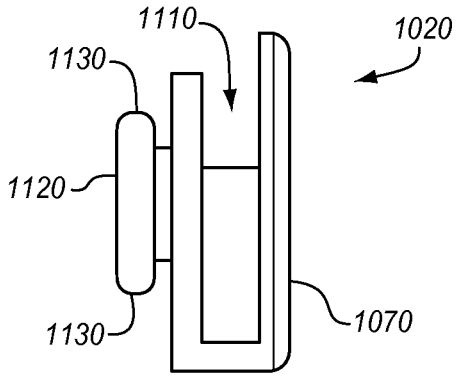
FIG. 11
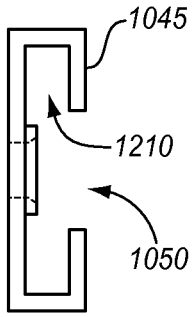
FIG. 12

FIG. 13A
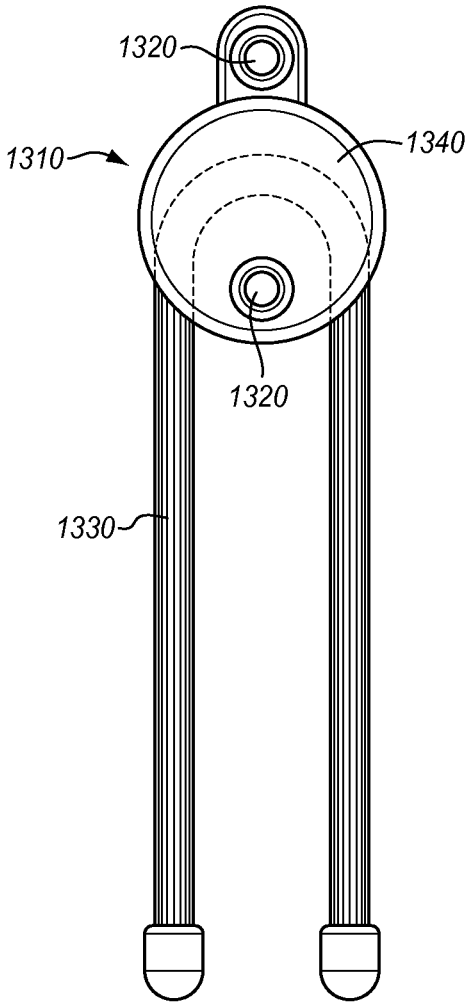
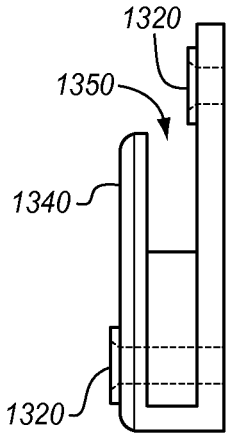
FIG. 13B

SYSTEMS AND METHODS FOR MOUNTABLE AND CONNECTABLE TWIST TIES

CROSS-REFERENCE TO RELATED APPLICATIONS

This application is a National Stage of PCT Application No. PCT/US2014/027506 filed on Mar. 14, 2014, which PCT application claims the benefit of U.S. Provisional Application No. 61/800,219 filed Mar. 15, 2013. The above PCT and provisional patent applications are hereby incorporated by reference to the same extent as though fully contained herein.

BACKGROUND

Twist ties may be used to secure and hold a variety of objects. It is desirable for users to mount twist ties, especially those with high-end performance characteristics, in a variety of temporary and more permanent configurations, so that objects may be secured in useful positions.

SUMMARY

In one embodiment, an apparatus for securing items includes a twist tie and a looped end for the twist tie, the looped end molded around the twist tie. Optionally, the twist tie includes an elongated piece of shape-retaining deformable material and a cover covering the shape-retaining deformable material along a length of said elongated piece, the cover and the shape-retaining deformable material being bonded along their length. Optionally, the twist tie includes an outer cover covering the cover, the outer cover bonded to the cover, wherein said cover has an interior surface, the cover being bonded to the elongated piece of shape-retaining deformable material along the entire interior surface of the cover, wherein the cover has a durometer of greater than 50 A and the outer cover has a durometer of less than 50 A. In one alternative, said outer cover has ribs. In another alternative, said cover and outer cover are thermoplastic polymers. Optionally, the outer cover is composed of a softer material than said cover. In one alternative, the twist tie has a gripping surface. In another alternative, the gripping surface includes outwardly extending ribs. Optionally, the cover has a durometer of approximately 85 A and the outer cover has a durometer of approximately 15 A. In one configuration, the looped end has a circular opening. In another configuration, the looped end is composed of nylon with glass fibers. Optionally, the outer cover provides a high friction gripping surface for gripping objects or gripping said twist tie device when said device is twisted together.

In another embodiment, an apparatus includes a body, the body including an attachment mechanism for mounting the body; and a twist tie, the twist tie integrated with the body. Optionally, the attachment mechanism is a hole in the body for receiving a connector. In one alternative, the attachment mechanism is a defined area in the body for receiving a fastener, wherein the defined area includes a raised perimeter surrounding the defined area, the raised perimeter preventing the tearing of the body when the defined area is penetrated by the fastener. In another alternative, the attachment mechanism is an L-shaped arm configured for insertion into a slatboard. Optionally, the attachment mechanism includes a knob extending from the body, the knob including a next, narrower than a head of the knob, the knob configured to slid into a track in a screw on a track mounting system. Alternatively, the track includes a top and bottom holding portion for holding the head of the knob. Optionally, the twist tie is integrated into the body by molding the body around the twist tie. In one alternative, the twist tie is integrated into the body by molding an aperture sized to slidably receive the twist tie. In one configuration, the aperture includes teeth for providing additional friction between the aperture and the twist tie. In another configuration, the twist tie is integrated into the body by providing a slot sized to receive the twist tie. Optionally, the slot includes ridges for providing additional friction between the aperture and the twist tie.

In another embodiment, an apparatus for securing items includes a twist tie; a body receiving the twist tie, the body including an attachment mechanism; and a decorative attachment, the decorative attachment attached to the body using the attachment mechanism. Optionally, the attachment mechanism is a friction fit mechanism utilizing a post in one of the attachment mechanism and the decorative attachment and a receiver in one of the attachment mechanism and the decorative attachment, wherein the receiver compresses and frictionally holds the post. Alternatively, the attachment mechanism is a snap fit mechanism. In another alternative, the decorative attachment is removable and interchangeable with another decorative attachment. Optionally, the body is molded around the twist tie.

BRIEF DESCRIPTION OF THE DRAWINGS

FIG. 10 shows an embodiment of a slot mountable twist tie;

FIG. 11 shows a cross-section of the twist tie mount of FIG. 10;

FIG. 12 shows a cross-section of the slot for mounting the twist tie of FIG. 10;

FIG. 13*a* shows an embodiment of a screw mountable twist tie;

FIG. 13*b* shows a cross-section FIG. 13*a;*

DETAILED DESCRIPTION OF THE DRAWINGS

Described herein are embodiments of mountable and attachable twist ties and methods of using and making them.

Figure 1:
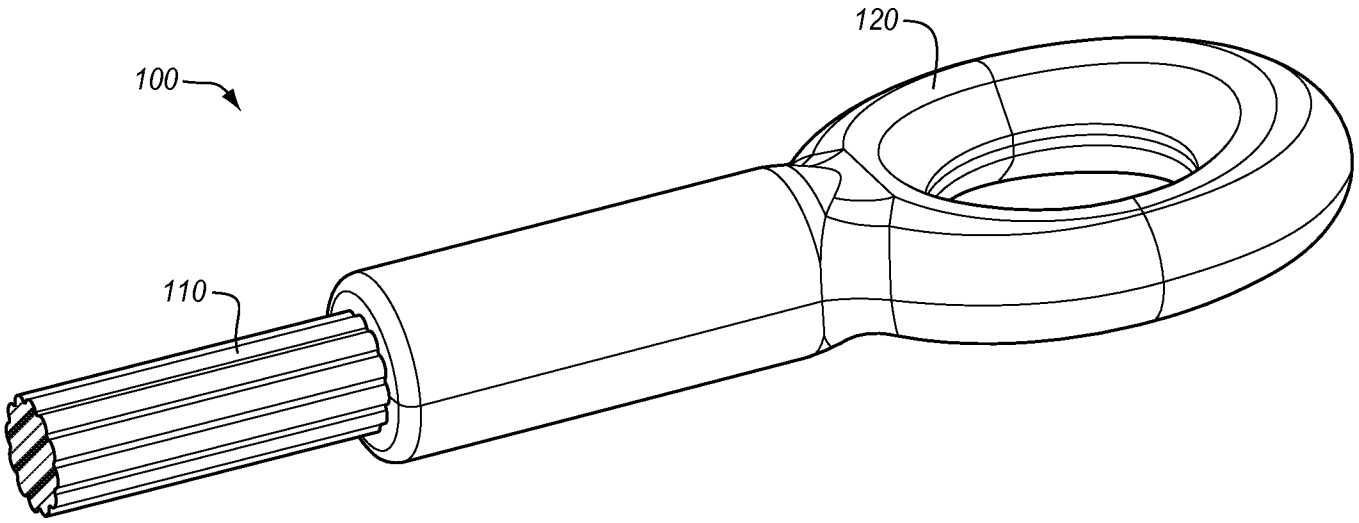
FIG. 1 shows one embodiment of a twist tie with ring end.

FIG. 1 shows one embodiment of a mountable and attachable twist tie, specifically a twist tie with a ring end 100. Twist tie with a ring end 100 includes a twist tie portion 110 and a molded ring end portion 120. Twist tie with a ring end 100 is formed by molding ring end 120 around twist tie portion 110. Ring end 120 may be composed of a variety of materials including, but not limited to, plastics, rubbers, nylon, etc. In the embodiment shown, ring end 120 is composed of nylon with glass fiber. In the embodiment shown, twist tie portion 110 is a Gear Tie™ twist tie and it includes special proprieties improving its function. Gear Tie™ twist ties include a softer durometer outer plastic layer of having a durometer less than 50 shore A and having an inner plastic layer of a harder durometer of greater than 50 shore A. Furthermore, the inner layer is bonded to the wire and the outer layer is bonded to the inner layer. In some alternatives of twist tie with a ring end 100, the twist tie portion has a softer outer layer of a durometer of less than 100 shore A. In some alternatives, this outer durometer is less than 50 shore A. In these embodiments with a softer outer plastic layer, the twist tie portion may be passed through the aperture of the end ring portion 120. When the durometer is softer on the outer layer, this configuration may slightly compress the outer layer and result in a firmly held loop configuration. In this alternative and other related alternatives, the aperture of ring end 120 may be sized to accommodate twist tie portion 110. The aperture may be made slightly smaller than the diameter of twist tie 110. Furthermore, the aperture of ring end 120 may include protrusions or teeth that may add to the grip of twist tie 110 as it is passed through the aperture.

Figure 2:
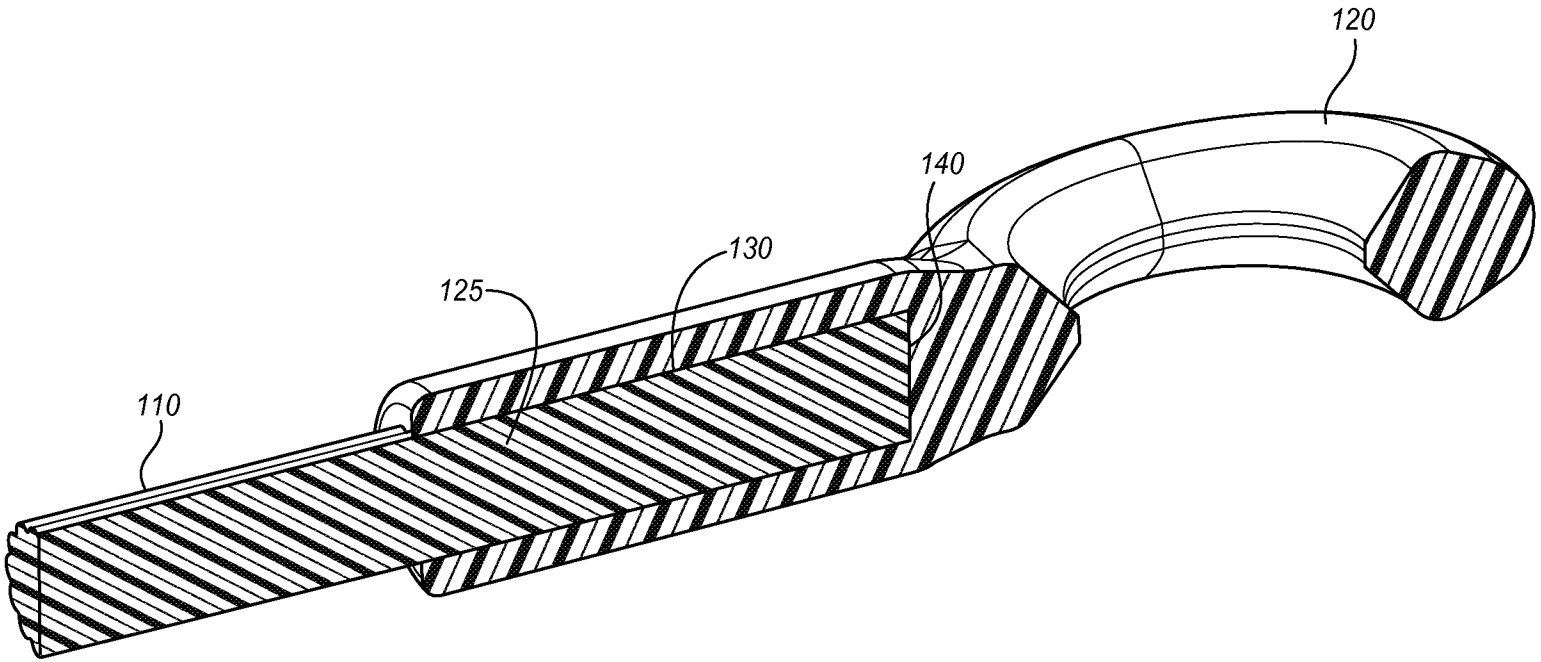
FIG. 2 shows a cross-section of the twist tie of FIG. 1.

FIG. 2 shows a cut-away view of twist tie with a ring end 100. Twist tie 110 includes a molded-in-place portion 125 around which nylon portion 130 is molded. Twist tie 110 may be molded to extend up to area 140.

Figure 3:
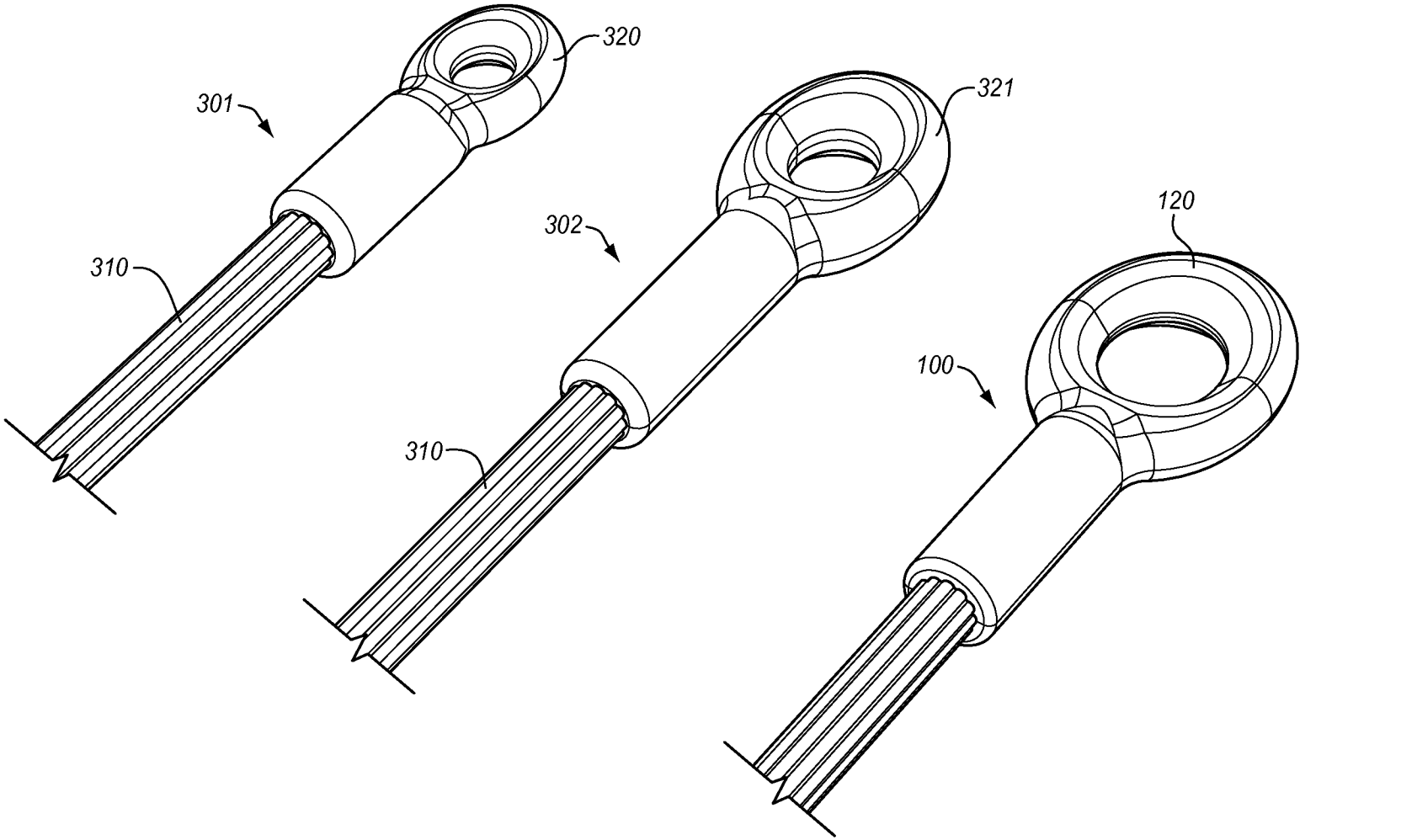
FIG. 3 shows additional embodiments of a twist tie with a ring end.

FIG. 3 shows various sizes of twist ties with ring ends 302, 302, 100 that may be formed. Various shapes may be molded at the end of gear ties with ring ends 302, 302, 100. As before, twist ties with ring ends 302, 302, 100 include twist ties 310, 110 and rings 320, 321, 120. In the embodiments shown, twist ties with ring ends 302, 302, 100 have ring-shaped ends. In alternatives, other shapes may be molded at the end. Ring ends may be configured to be set on a key chain or an attachment mechanism, such as a double-gated carabineer, like an S-Biner double-gated carabineer. This may provide for optimal engagement and attachment of twist ties with ring ends 302, 302, 100.

Figure 4:
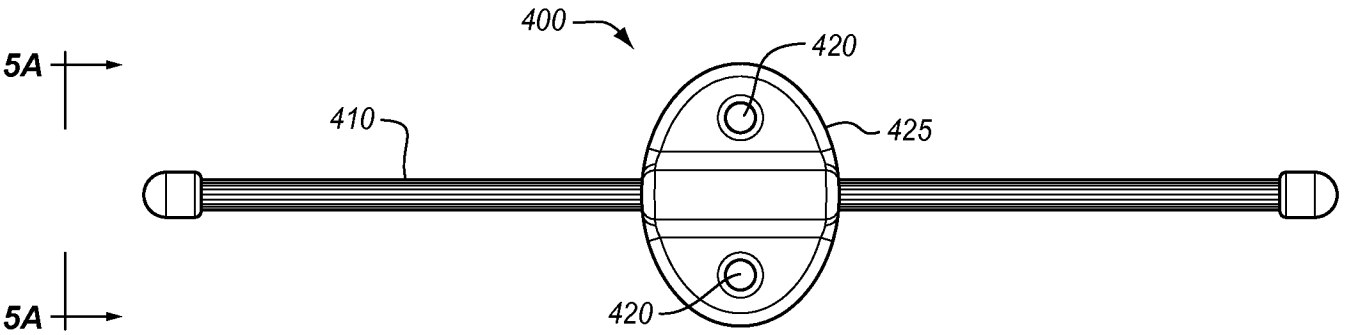
FIG. 4 shows an embodiment of a screw mountable twist tie.
Figure 5B:
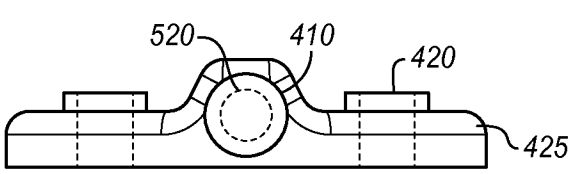
FIGS. 5*a* and 5*b* show cross-sections of two embodiments of a screw mountable twist tie.
Figure 5A:
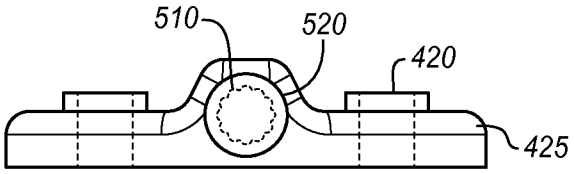
Figure 6:
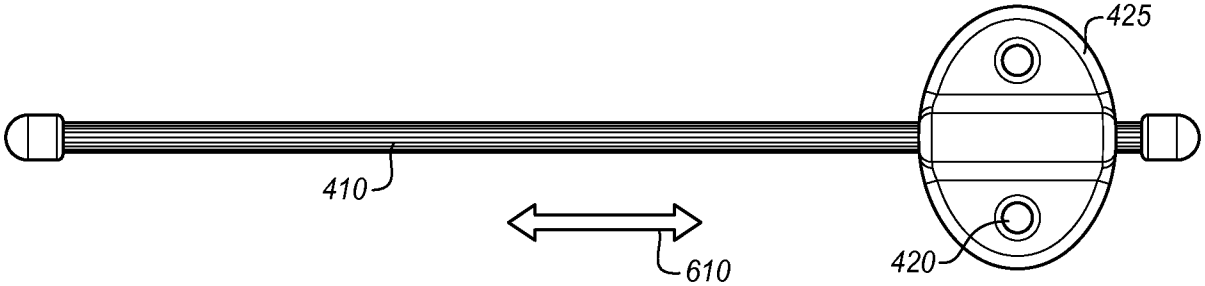
FIGS. 6-9 show additional embodiments of a screw mountable twist tie.

FIGS. 4-6 show another embodiment of a mountable and attachable twist tie. FIG. 4 shows screw mountable twist tie 400. Screw mountable twist tie 400 includes a twist tie 410 (may be a gear tie as explained above, and may have special durometers and bonding properties as explained above). A mount 425 is molded to twist tie 410. As with all embodiments described herein, the molding may be accomplished by placing twist tie 410 in a specially shaped mold with a holder for twist tie 410 and then molding around twist tie 410. Mount 425 includes attachment mounting area 420, through which a nail or screw may be driven. Mounting areas 420 include a raised lip portion that assists in preventing the ripping of the material of the mount 420. Mount 420 may be composed of a variety of materials including, but not limited to, plastic, nylon, and glass fiber. Throughout this application, embodiments including nylon with glass fiber may be composed of nylon 66 with 30% glass fiber.

FIG. 6 shows an alternative embodiment of screw mountable twist tie 400 where the aperture for twist tie 410 is not molded and bonded to twist tie 410. In this case, twist tie 410 may be slid back and forth according to directional arrow 610.

FIG. 5*a* shows a cross-section of FIG. 6, where mount 420 includes aperture 520 and teeth 510. Aperture 520 may be sized slightly larger or slightly smaller than the diameter of twist tie 410. In some alternatives, the addition of screws may cause aperture 520 to be compressed slightly, causing teeth 521 to more tightly grip twist tie 410. In all embodiments described herein, twist tie 410 (110, etc.) may include ridges formed on the outer surface to increase the gripping nature of twist tie 410.

FIG. 5*b* shows a cross-section of the embodiment of FIG. 4 where aperture 520 is molded directly around twist tie 410 in a bonded and non-movable fashion.

Figure 9:
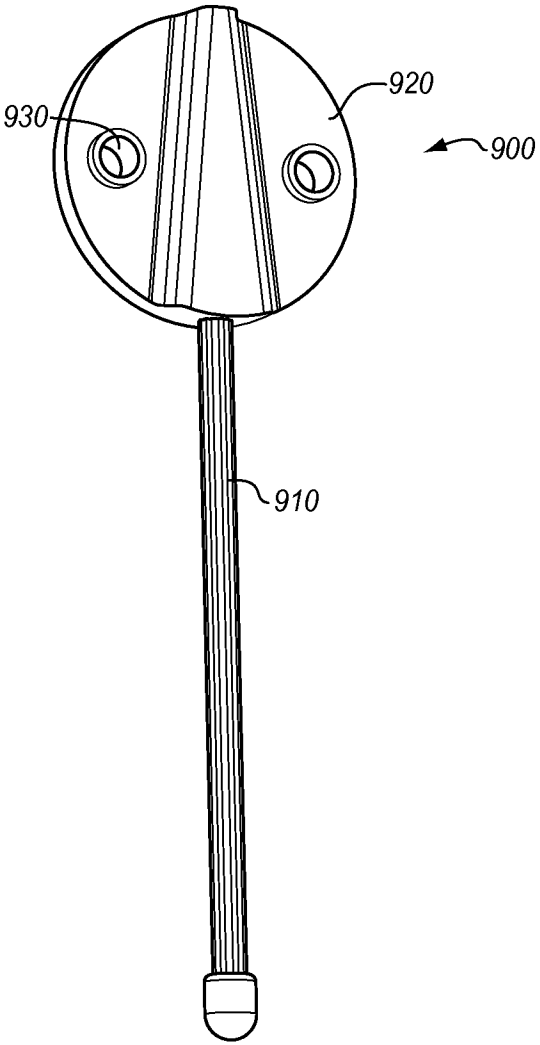
Figure 8:
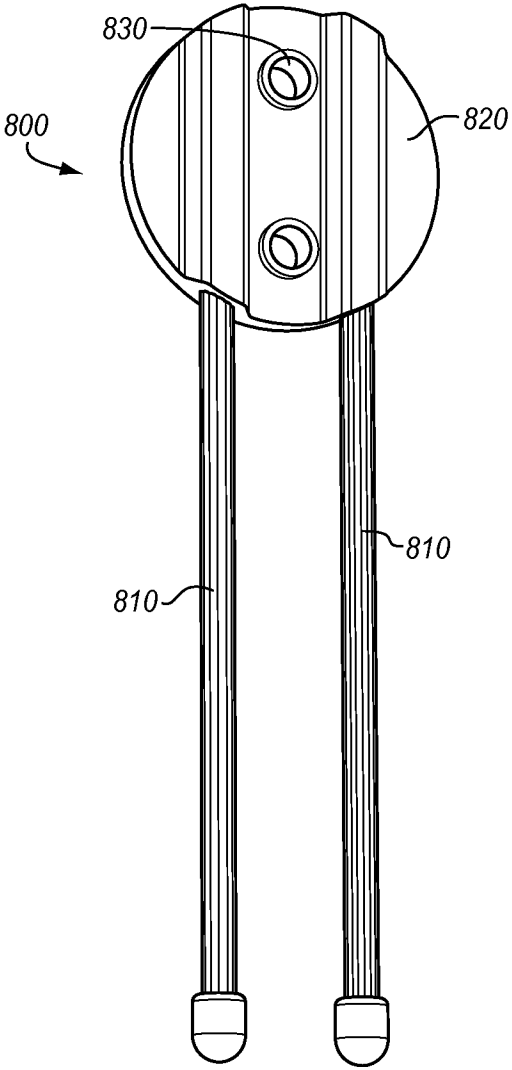
Figure 7:
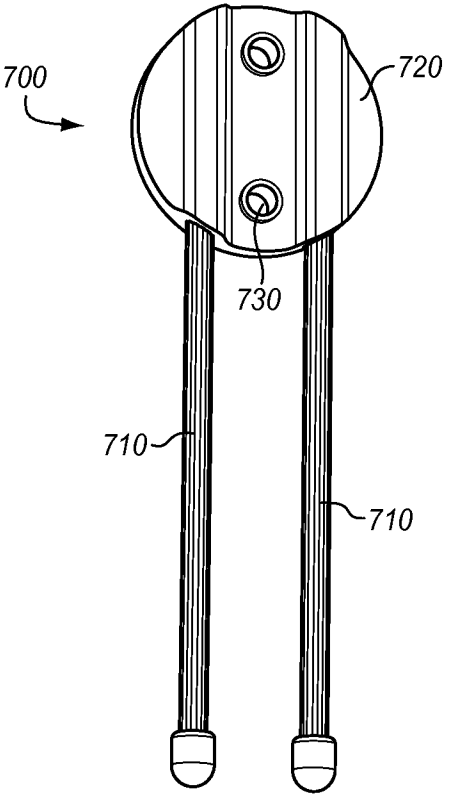

FIG. 7 shows another embodiment of a screw mountable twist tie 700, including two twist ties 710, mount 720, and screw receivers 730. This embodiment may be constructed as shown, in a fixed manner, similar to screw mountable twist tie 400 or may be configured similarly to screw mountable twist tie 600 (not shown). FIG. 8 shows another embodiment of a screw mountable twist tie 800, including two twist ties 810, mount 820, and screw receivers 830. This embodiment may be constructed as shown, in a fixed manner, similar to screw mountable twist tie 400 or may be configured similarly to screw mountable twist tie 600 (not shown). FIG. 9 shows another embodiment of a screw mountable twist tie 900, including twist tie 910, mount 920, and screw receivers 930. This embodiment may be constructed as shown, in a fixed manner, similar to screw mountable twist tie 400 or may be configured similarly to screw mountable twist tie 600 (not shown). As will be apparent to those skilled in the art in light of this disclosure, various mounts and arrangements and numbers of twist ties will be possible.

FIG. 10 shows another embodiment of mountable and attachable twist ties. Slot mountable twist tie system 1010 includes slot mountable twist tie 1020 configured to fit into track 1030. Track 1030 includes slide area 1050, end cap 1040, and top and bottom overhangs 1045. Slot mountable twist tie 1020 includes a body portion 1070 and a twist tie 1060. In operation, slot mountable twist tie 1020 may be slid into the slide area 1050 after removing an end cap 1040. Track 1030 may include multiple mounting holes 1055 that may be used to mount slot mountable twist tie system 1010 with screws, nails, bolts, or other attachment mechanisms.

FIG. 11 shows a side view of the slot mountable twist tie 1020. Slot mountable twist tie 1020 includes a slide mount 1120 having a T-shape with tabs 1130 that fit under overhangs 1045. Alternatively, various slide mount shapes and configurations will be apparent to those skilled in the art in light of this disclosure. Slot mountable twist tie 1020 further includes receiving slot 1110. The front side of receiving slot (and the rear side), adjacent to the front face of the body 1070 may include teeth, ribs, or protrusions, such that the twist tie 1060, may be further gripped by these protrusions. In the embodiment shown, the twist tie may be repositioned in a variety of different configurations in slot 1110.

FIG. 12 shows a side view of track 1030. Tabs 1130 fit into area 1210 and hold the slot mountable twist tie 1020 in the track 1030.

FIG. 13*a* shows another embodiment of mountable and attachable twist ties. In this embodiment, mount 1310 may be mounted using holes 1320, which may receive screws, nails, or other fasteners. Mount 1310 includes a front body portion 1340 and a twist tie 1330. This embodiment is similar to the embodiment of FIG. 10, except that it includes screw mounts instead of track mounts. FIG. 13*b* shows the cross-sectional view of the mount 1310. The mount 1310 includes slot 1350 for receiving gear tie 1330. The back side of front body portion 1340 may also include ribs to prevent the slide of the twist tie 1330 as described above.

Figure 14A:
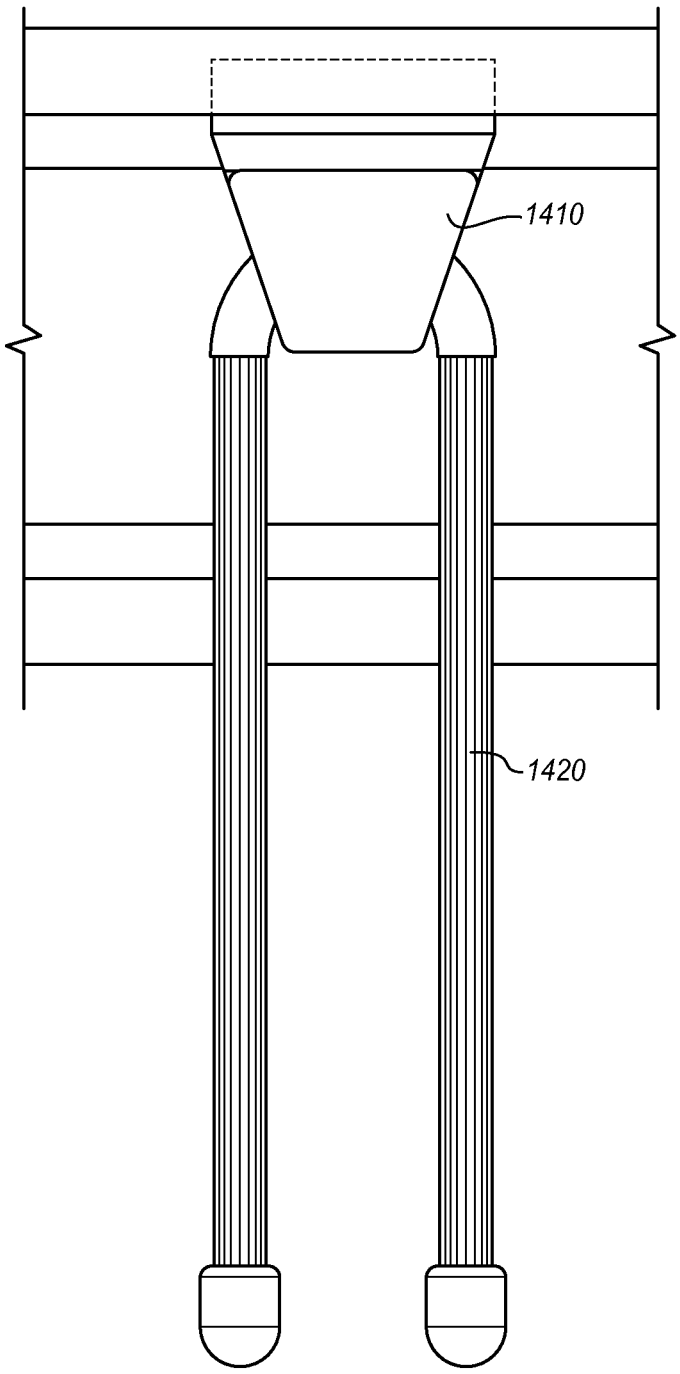
FIGS. 14*a* and 14*b* show one embodiment of a slatboard mounted twist tie.
Figure 14B:
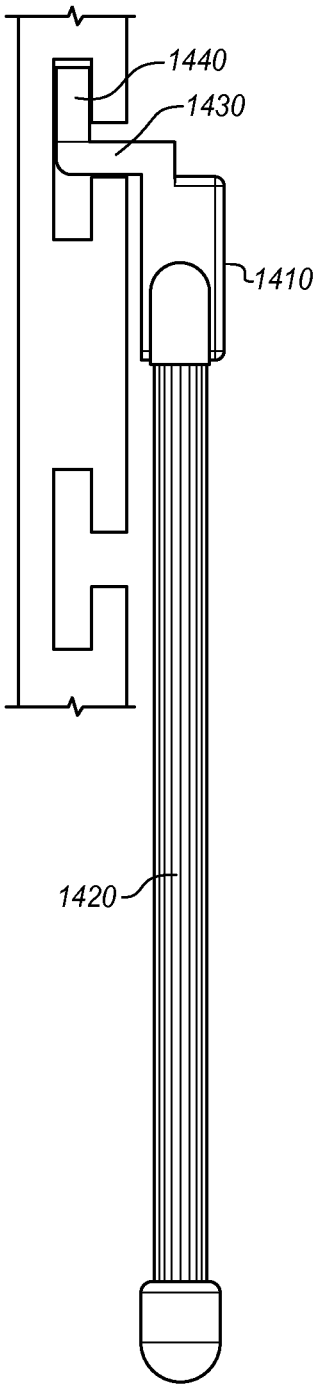
Figure 15A:
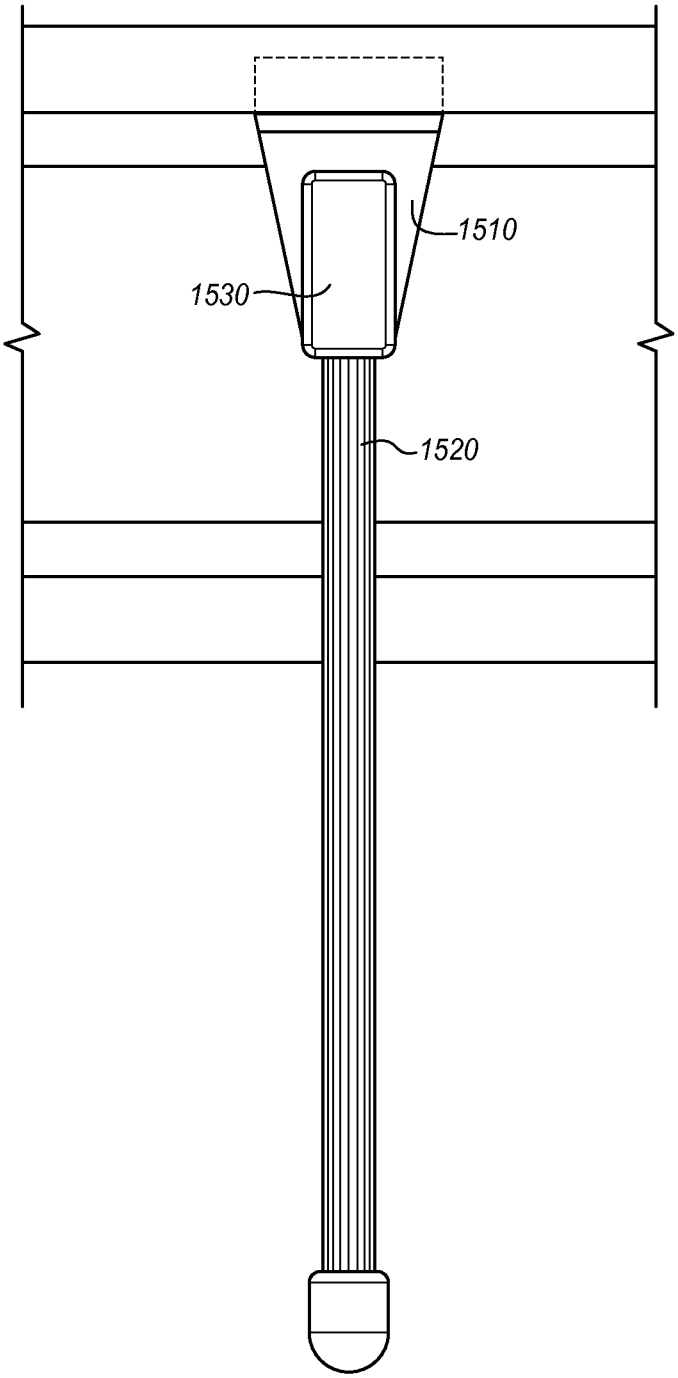
FIGS. 15*a* and 15*b* show one embodiment of a slatboard mounted twist tie.
Figure 15B:
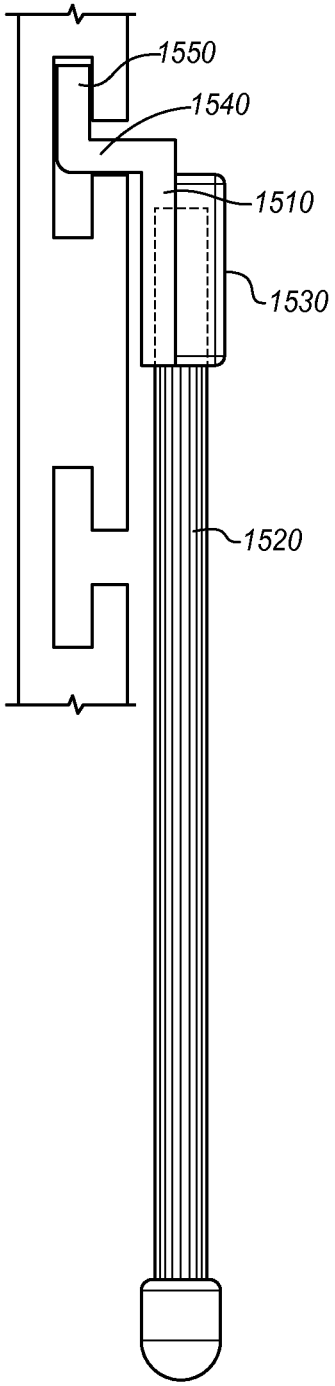

FIGS. 14*a*-15*b* show another embodiment of mountable and attachable twist ties. FIG. 14*a* shows a slatboard mountable mount 1410 with twist tie 1420. As above, twist tie 1420 may be slidably mounted, removably mounted, or permanently fixed in the mount 1410. FIG. 14*b* shows a side view of the mount 1410, including slat insertion arm 1430 and peg 1440. FIG. 15*a* shows a slatboard mountable mount 1510 with twist tie 1520. Twist tie 1520 is permanently fixed in the mount 1510. FIG. 15*b* shows a side view of mount 1510, including slat insertion arm 1530 and peg 1540.

Figure 16A:
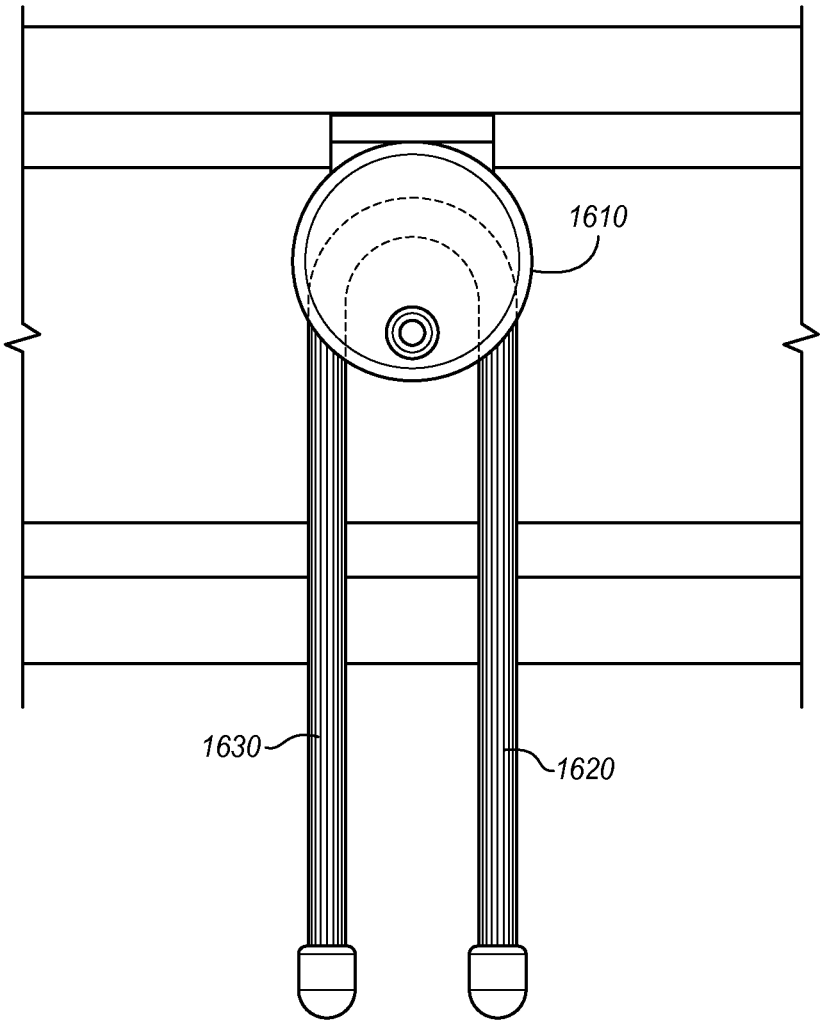
FIGS. 16*a* and 16*b* show one embodiment of a slatboard mounted twist tie.
Figure 16B:
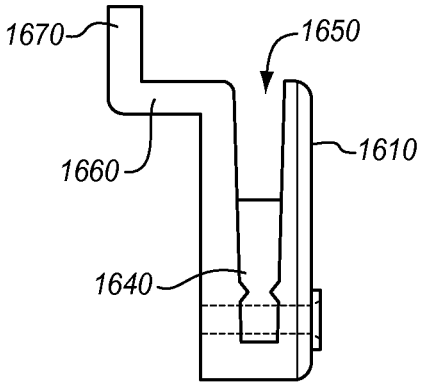

FIG. 16*a* shows a slatboard mountable mount 1610 with twist tie 1620. As above, twist tie 1620 may be slidably mounted, removably mounted, or permanently fixed in the mount 1610. FIG. 16*b* shows a side view of mount 1610, including slat insertion arm 1660 and peg 1670. In this case, mount 1610 is configured for removal of twist tie 1620, having slot 1650 and curved lower portion 1640. As with previous mounts having removable twist ties, the curved lower portion 1640 provides for a distribution of weight over a greater area of twist tie 1620. This helps prevent twist tie 1620 from breaking and increases the surface area where twist tie 1620 contacts the body of mount 1610, resulting in greater friction to prevent sliding.

Figure 17:
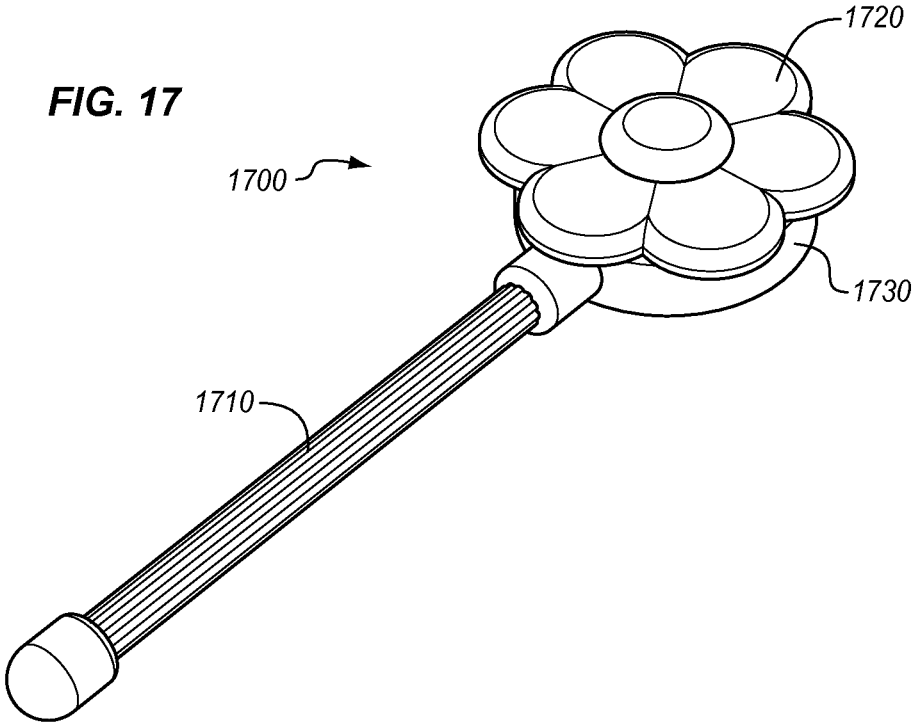
FIG. 17 shows one embodiment of a twist tie with decorative attachment.

FIG. 17 shows another embodiment of mountable and attachable twist ties. Here a twist tie with interchangeable decorative end 1700 is shown. Included are a decorative top 1720 that may be of any shape and bear various graphics and colors, twist tie 1710, and base 1730.

Figure 18:
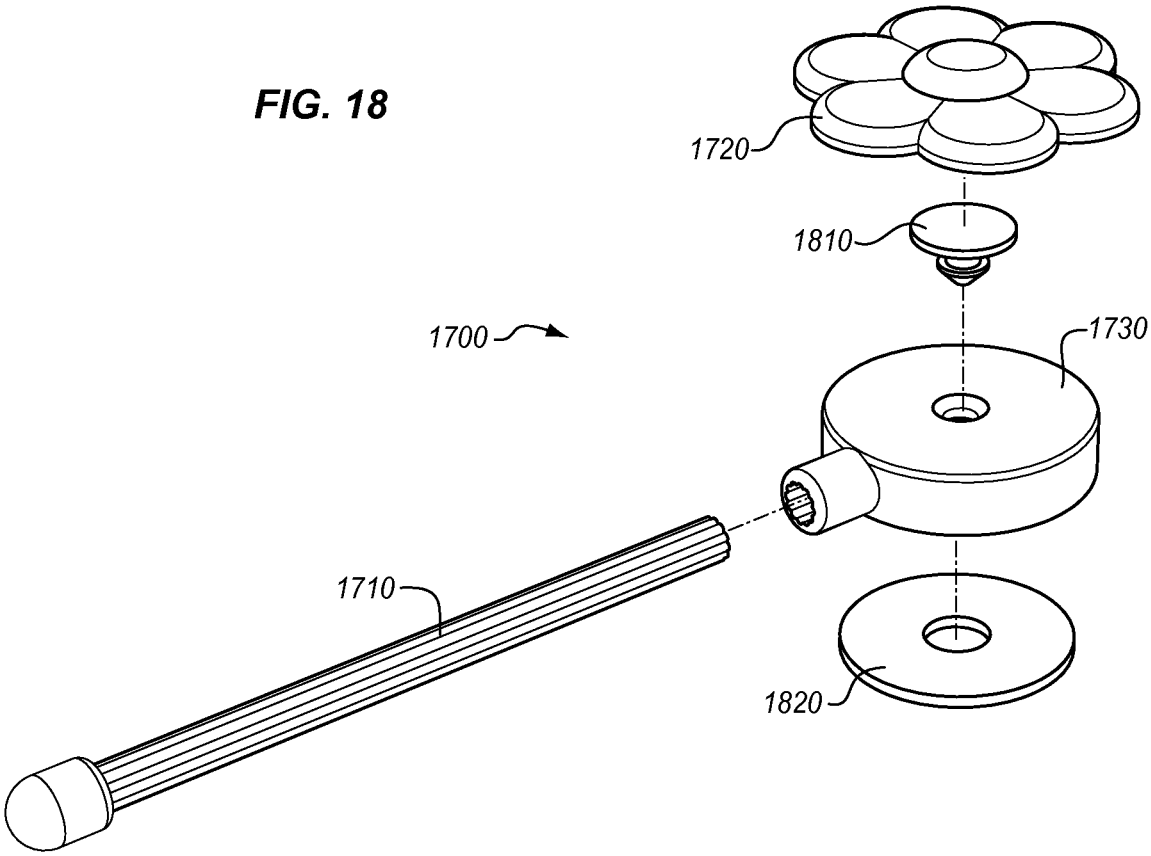
FIG. 18 shows an exploded view of FIG. 17.
Figure 19:
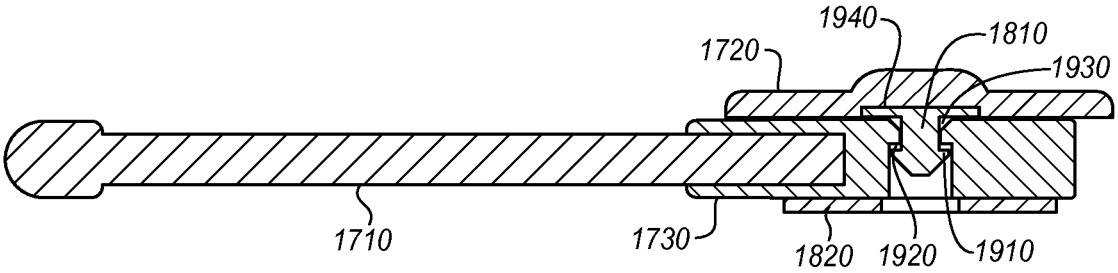
FIG. 19 shows a cross-sectional view of FIG. 17.
Figure 20:
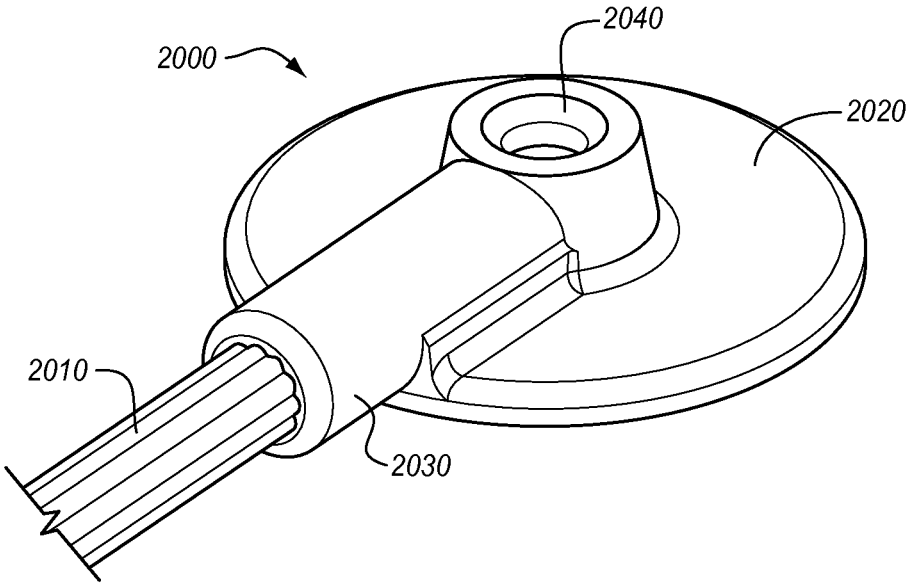
FIG. 20 shows an alternative embodiment of a twist tie for receiving a decorative attachment.

FIG. 18 shows an exploded view of the twist tie with interchangeable decorative end 1700. Snap fit male end 1810 is shown, as well as base portion 1820. In FIG. 19, the engagement and arrangement of twist tie with interchangeable decorative end 1700 is shown. Visible here is how twist tie 1710 fits into base 1730 and snap fit male end 1810 integrates with decorative top 1720. One end 1940 of snap fit male end 1810 may be glued or otherwise attached to decorative top 1720. The other end includes male wedge and tab portion 1910 that is configured to wedge past wedge-shaped opening 1930 and hold fast against perpendicular holder 1920. FIG. 20 shows another embodiment of a twist tie with interchangeable decorative end 2000 without the decorative cover. In this alternative, the profile of the base portion 2020 is reduced. Twist tie with interchangeable decorative end 2000 includes a receiving aperture 2040 for the decorative top (not shown) and an aperture 2030 for receiving twist tie 2010. In this alterative, the receiving aperture may merely be a friction-based holder, where the peg is angled so that it gets slightly larger than aperture 2030 or the aperture gets slightly more narrow (or both).

The previous detailed description is of a small number of embodiments for implementing the systems and methods for creating mountable and attachable twist ties and the systems of mountable and attachable twist ties and is not intended to be limiting in scope. The following claims set forth a number of the embodiments of the systems and methods for creating mountable and attachable twist ties and the systems of mountable and attachable twist ties disclosed with greater particularity.

The invention claimed is:

1. An apparatus for securing items, the apparatus comprising:

a twist tie; and an end for the twist tie, wherein the end comprises a nylon portion molded to the twist tie and a ring end defining an aperture sized to accommodate the twist tie to grip the twist tie as the twist tie is passed through the aperture, and wherein the aperture comprises protrusions or teeth adding to the grip of the twist tie as the twist tie is passed through the aperture, wherein the twist tie includes:

an elongated piece of shape-retaining deformable material;

a cover covering the shape-retaining deformable material along a length of said elongated piece, the cover and the shape-retaining deformable material being bonded along their length; and an outer cover covering the cover, the outer cover bonded to the cover, wherein said cover has an interior surface, the cover being bonded to the elongated piece of shape-retaining deformable material along the entire interior surface of the cover, wherein the cover has a durometer of greater than 50 A and the outer cover has a durometer of less than 50 A.

2. The apparatus of claim 1, wherein said outer cover has ribs.

3. The apparatus of claim 1, wherein said cover and outer cover are thermoplastic polymers.

4. The apparatus of claim 1, wherein said outer cover is composed of a softer material than said cover.

5. The apparatus of claim 1, wherein the twist tie has a gripping surface that grips the ring end as the twist tie is passed through the aperture.

6. The apparatus of claim 5, wherein the gripping surface includes outwardly extending ribs.

7. The apparatus of claim 1, wherein the cover has a durometer of approximately 85 A and the outer cover has a durometer of approximately 15 A.

8. The apparatus of claim 1, wherein the ring end has a circular cross-section transverse to a length of a ring defining the aperture.

9. The apparatus of claim 1, wherein the end is composed of nylon with glass fibers.

10. The apparatus of claim 1, wherein the outer cover provides a high friction gripping surface for gripping objects or gripping the ring end when the twist tie is passed through the aperture.

11. An apparatus for securing items, the apparatus comprising:

a twist tie, the twist tie having opposing first and second end portions defining terminal ends of the twist tie; and an end connected to the twist tie and comprising a nylon portion molded to the first end portion of the twist tie and an aperture defined by a closed loop to grip the twist tie as the second end portion of the twist tie is passed through the aperture, the aperture sized such that it compresses the second end portion of the twist tie when the second end portion of the twist tie is passed through the aperture, the aperture including protrusions or teeth adding to the grip of the twist tie as the second end portion of the twist tie is passed through the aperture, wherein the twist tie includes:

an elongated piece of shape-retaining deformable material;

a cover covering the shape-retaining deformable material along a length of said elongated piece, the cover and the shape-retaining deformable material being bonded along their length; and an outer cover covering the cover, the outer cover bonded to the cover, wherein said cover has an interior surface, the cover being bonded to the elongated piece of shape-retaining deformable material along the entire interior surface of the cover, wherein the cover has a durometer of greater than 50 A and the outer cover has a durometer of less than 50 A.

12. An apparatus for securing items, the apparatus comprising:

a twist tie, the twist tie having a molded-in-place portion; and an end for the twist tie, the end comprising a nylon portion molded to the molded-in-place portion of the twist tie and an end ring portion having an aperture configured to grip the twist tie as the twist tie is passed through the aperture, the aperture sized slightly smaller than a diameter of the twist tie and including protrusions or teeth adding to the grip of the twist tie as the twist tie is passed through the aperture to loop the twist tie around an object, wherein the twist tie includes:

an elongated piece of shape-retaining deformable material;

a cover covering the shape-retaining deformable material along a length of said elongated piece, the cover and the shape-retaining deformable material being bonded along their length; and an outer cover covering the cover, the outer cover bonded to the cover, wherein said cover has an interior surface, the cover being bonded to the elongated piece of shape-retaining deformable material along the entire interior surface of the cover, wherein the cover has a durometer of greater than 50 A and the outer cover has a durometer of less than 50 A.

13. The apparatus of claim 1, wherein the aperture defines an axis that is transverse to a long axis of the twist tie.

14. The apparatus of claim 11, wherein the outer cover provides a gripping surface for gripping objects or gripping the closed loop when the twist tie is passed through the aperture.

15. The apparatus of claim 14, wherein the gripping surface includes outwardly extending ribs.

16. The apparatus of claim 11, wherein the aperture defines an axis that is transverse to a long axis of the twist tie.

17. The apparatus of claim 11, wherein the cover and the outer cover are thermoplastic polymers.

18. The apparatus of claim 11, wherein the cover has a durometer of approximately 85 A and the outer cover has a durometer of approximately 15 A.

19. The apparatus of claim 12, wherein the outer cover provides a gripping surface for gripping objects or gripping the end ring portion when the twist tie is passed through the aperture.

20. The apparatus of claim 19, wherein the gripping surface includes outwardly extending ribs.

21. The apparatus of claim 12, wherein the aperture defines an axis that is transverse to a long axis of the twist tie.

22. The apparatus of claim 12, wherein the cover and the outer cover are thermoplastic polymers.

23. The apparatus of claim 12, wherein the cover has a durometer of approximately 85 A and the outer cover has a durometer of approximately 15 A.

* * * * *